US006675889B1

(12) United States Patent
Mullins et al.

(10) Patent No.: US 6,675,889 B1
(45) Date of Patent: Jan. 13, 2004

(54) TUBULAR FILLING SYSTEM

(75) Inventors: Albert Augustus Mullins, Humble, TX (US); Raul Daniel Vega, Houston, TX (US)

(73) Assignee: Offshore Energy Services, Inc., Broussard, LA (US)

( * ) Notice: Subject to any disclaimer, the term of this patent is extended or adjusted under 35 U.S.C. 154(b) by 284 days.

(21) Appl. No.: 09/635,150

(22) Filed: Aug. 8, 2000

Related U.S. Application Data

(63) Continuation-in-part of application No. 09/161,051, filed on Sep. 25, 1998, now Pat. No. 6,390,190.
(60) Provisional application No. 60/084,964, filed on May 11, 1998.

(51) Int. Cl.[7] ..... E21B 19/16; E21B 21/00
(52) U.S. Cl. ..... 166/90.1; 166/177.4; 175/218
(58) Field of Search ..... 175/218, 317, 175/324; 166/90.1, 319, 321, 325, 330, 177.4

(56) References Cited

U.S. PATENT DOCUMENTS

| | | | | |
|---|---|---|---|---|
| 1,662,311 A | | 3/1928 | Hamer | |
| 1,866,726 A | | 7/1932 | Santiago | |
| 2,223,388 A | | 1/1940 | Scaramucci | |
| 2,620,037 A | | 12/1952 | McClendon | |
| 3,361,453 A | | 1/1968 | Brown et al. | |
| 3,698,426 A | * | 10/1972 | Litchfield et al. | 137/496 |
| 3,863,716 A | | 2/1975 | Streich | |
| 3,915,226 A | | 10/1975 | Savage | |
| 4,076,083 A | | 2/1978 | Sizer | |
| 4,100,968 A | | 7/1978 | Delano | |
| 4,111,261 A | | 9/1978 | Oliver | |
| 4,188,050 A | | 2/1980 | Lochte | |
| 4,246,967 A | | 1/1981 | Harris | |
| 4,290,482 A | | 9/1981 | Brisco | |
| 4,364,407 A | * | 12/1982 | Hilliard | 137/493.2 |
| 4,433,725 A | | 2/1984 | Bowyer | |
| 4,522,430 A | | 6/1985 | Stromberg | |
| 4,524,998 A | | 6/1985 | Brisco | |
| 4,566,168 A | | 1/1986 | Stromberg | |
| 4,613,161 A | | 9/1986 | Brisco | |
| 4,624,483 A | | 11/1986 | Stromberg | |
| 4,625,755 A | * | 12/1986 | Reddoch | 137/327 |
| 4,655,286 A | | 4/1987 | Wood | |
| 4,655,302 A | | 4/1987 | McCreadie et al. | |
| 4,658,905 A | * | 4/1987 | Burge | 166/325 |
| 4,718,495 A | | 1/1988 | Lubitz et al. | |
| 4,817,724 A | | 4/1989 | Funderburg, Jr. et al. | |
| 4,913,231 A | | 4/1990 | Muller et al. | |

(List continued on next page.)

FOREIGN PATENT DOCUMENTS

WO WO93/07358 4/1993

OTHER PUBLICATIONS

B.J. Hughes Brochure, "Subsea Cementing Systems", p. 600.
B&W Incorporated Brochure, "B&W Rotating Surface Casing Cementing Method", p. 502.
B&W Incorporated Brochure, "Gravel Compaction", pp. 509–510.
TAM International Brochure, "TAM Casing Circulating Packer", 1991.

(List continued on next page.)

*Primary Examiner*—Hoang Dang
(74) *Attorney, Agent, or Firm*—Steve Rosenblatt

(57) ABSTRACT

A mudsaver valve having a large flow capacity is described to keep fluid from spilling when the apparatus is removed from the tubular. This mudsaver valve also provides for pumping of fluid into the tubular or flow of fluid from the tubular to the mud system prior to removing the apparatus from the tubular. In these embodiments, the apparatus can be placed in threaded sealing contact with the tubular and can incorporate a safety valve that can be manually closed in the event of a well kick.

13 Claims, 10 Drawing Sheets

U.S. PATENT DOCUMENTS

| | | | | |
|---|---|---|---|---|
| 4,997,042 | A | | 3/1991 | Jordan et al. |
| 5,152,554 | A | | 10/1992 | LaFleur et al. |
| 5,191,939 | A | | 3/1993 | Stokley |
| 5,236,035 | A | | 8/1993 | Brisco et al. |
| 5,249,629 | A | | 10/1993 | Jennings |
| 5,282,653 | A | | 2/1994 | LaFleur et al. |
| 5,348,351 | A | | 9/1994 | LaFleur et al. |
| 5,411,095 | A | | 5/1995 | Ehlinger et al. |
| 5,413,171 | A | | 5/1995 | Womack |
| 5,435,390 | A | | 7/1995 | Baugh et al. |
| 5,441,310 | A | | 8/1995 | Barrett et al. |
| 5,443,122 | A | | 8/1995 | Brisco |
| 5,499,687 | A | | 3/1996 | Lee |
| 5,501,280 | A | | 3/1996 | Brisco |
| 5,553,667 | A | | 9/1996 | Budde et al. |
| 5,577,566 | A | | 11/1996 | Albright et al. ..... 175/321 |
| 5,584,343 | A | | 12/1996 | Coone |
| 5,641,021 | A | | 6/1997 | Murray et al. |
| 5,645,131 | A | | 7/1997 | Trevisani |
| 5,660,234 | A | | 8/1997 | Hebert et al. |
| 5,682,952 | A | | 11/1997 | Stokley |
| 5,735,348 | A | | 4/1998 | Hawkins, III |
| 5,918,673 | A | * | 7/1999 | Hawkins et al. ..... 166/177.4 |
| 5,971,079 | A | | 10/1999 | Mullins |
| 5,992,520 | A | | 11/1999 | Schultz et al. |

OTHER PUBLICATIONS

Frank's Casing Crew & Rental Tools, Inc., Brochure, "HiTop Model FC–1 Fill–Up/Circulation Tool".
Frank's Casing Crew & Rental Tools, Inc., Technical Manual, "HiTop Oil Tools", Rev. A, Mar. 2, 1995.
Frank's Casing Crew & Rental Tools, Inc., Technical Manual, "HiTop Oil Tools", Rev. A, Feb. 28, 1995.
TAM International Article, "Running Procedure for" 11 & 7"" O.D. Casing Circulating Packer Fill–Up, 13 3/8" & 9 5/8" Casing, Mar. 9, 1993, pp. 1–2.
LaFeur Petroleum Services, Inc., Procedural Brochure, "Autoseal Circulating Head", Apr. 25, 1995, pp. 1–10.
Wassenborg, M., "Franks FC–1 Circulation Packer Washes 13 5/8" Casing to Bottom", The Brief, 6/95.
Halliburton Services, Technical Drawing #3481.
Davis–Lynch, Equipment Catalog No. 11, 1993, 866–895.
Halliburton Information, Oil & Gas Journal, p. 12.
Composite Catalog, 1965 "Brown Hyflo Liner Packers", p 944.
PBL Drilling Tools, Ltd., Brochure, Hydro Mechanical Casing Circulator.
Composite Catalog, "Brown Duo–Packer", p. 919.
Composite Catalog, Baker Packers, "Waterflood Systems", p. 701.
Composite Catalog, Arrow Oil Tools, Inc., Retrievable Bridge Plug, p. 296.
Composite Catalog, Bowen Power Equipment, Bowen Power Swivels, pp. 565, 567.
Wepco Brochure, "Hydraulically Operated Circulation Head".
Miscellaneous Information on Davis–Lynch, Inc. Fill and Circulate (FAC) Tool for Top Drive Drilling Systems, 2 pages, dated unknown.
Halliburton Services, Information on Quick–Latch Coupler Head, Oil & Gas Journal, 1 p., 10/88.
Misc. information on Halliburton Services Plug Containers, Selective Release Plug System and SSR(Sub–Surface Release)Cementing Plug Method, 4 pages, date unknown.
Frank's International, Brochure on Fill–Up & Cementing Tool System and FC–1 Fill–Up & Circulating Tool With Sliding Sleeve, 2 pages, date unknown.
Frank's Hilltop, drawings, 5 pages, date unknown
HiTop Oil Tools, Misc. information on Model FC–1 Fill–Up Circulation Tool, 2 pages, date unknown.
Drawing of Lafleur Petroleum Services AutoSeal Circulating Head, 1 page, date unknown.
Misc. information on Tam International Casing Circulating Packers, 8 pages, date unknown.
Guiberson Type GW Packer Cup; p. 1964 (1950 Composite).
Page Oil Tools, Inc. Bottom Hole Oil and Gas Separator ; p. 3965 (1950 Composite).
McGaffey–Taylor Corp., Oil Well Service; M& T Shoe Squeeze Tool; pp. 3634–3635; (1960 Composite).
Guiberson, GW Cup Type Packers; p. 2176; (1966/67).
Guiberson, Typical GW Packer Applications; p. 2177; (1966/67).
Guiberson, Type SJ Circulating Slide Valve; p. 2183; (1966/67).
Page Oil Tools, Page Forced Flow Downhole Separator, p. 3959; (1966/67).
CFT Drill Pipe Circulating & Flow–Back Tool Brochure, Gus Mullins & Associates, 1999, 2 pages.
Wepco information on Wepco Hydraulicall Operated Circulation Head for Casing Running in Highly Deviated–/tight wells, date unknown, 5 pages.

* cited by examiner

TUBULAR FILLING SYSTEM

This application is a continuation in part of application Ser. No. 09/161,051 filed Sep. 25, 1998, now U.S. Pat. No. 6,390,190 which claims the benefit of Ser. No. 60/084,964 filed May 11, 1998.

FIELD OF THE INVENTION

The field of this invention relates to an apparatus for filling or circulating fluids while inserting tubulars into or removing them from a wellbore and for recovery of fluids displaced when running tubulars into the wellbore. The field of this invention also relates to an apparatus for controlling a well.

BACKGROUND OF THE INVENTION

When tubulars are being run into or pulled from a wellbore, it is often necessary to fill the tubular, take returns from the tubular or circulate fluid through the tubular. This requires that the pipe be threaded to a circulation system or the use of a device for filling or circulating a wellbore. Previous devices for filling and circulating the wellbore are firmly attached to the traveling block or top drive. In either case a very precise spacing is required of the seal assembly relative to the tubular and elevators. In the case where slip-type elevators are used, the spacing of the seal could be such that when the elevators were near the upset of the tubular, the seal could be out of the tubular. When required, the slips at the rig floor must be set on the tubular and the traveling block or top drive lowered in order to move the seal into sealing engagement with the tubular. This required that the running or pulling of the tubular stop until the slips were set at the rig floor and the seal engagement be made. This is not desirable when a well kick occurs or fluid is overflowing from the tubular.

In the case where "side door" or latching elevators are used, the spacing of the seal system is very critical and the seal of previous devices must be engaged in the tubular prior to latching the elevators below the upset portion of the tubular. This requires that the seal be engaged in the tubular at all times that the elevators are latched on the tubular in order to facilitate circulation of fluids. When tubulars are racked back in the derrick such as multiple sections of drill pipe, it would be very time-consuming if not impossible to insert the seal into the tubular prior to latching the elevators. This is true either on automated pipe handling rigs or rigs with the top of the tubular far above the derrick man. There is a disadvantage in having the seal engaged in the tubular at all times that the elevators are latched. In these cases the top of the tubular can not be accessed as when it is necessary to place a safety valve into the upper tubular section or in, if a high-pressure line was to be attached to the tubular and the tubular moved after making the connection. All previous devices had to be "laid down" to allow a threaded connection to be made to the tubular since these devices are in the way of placing a new device into the upper tubular connection.

It will be seen that the invention described in this application, with its rapidly extending and retracting features and the ability to easily threadedly connect to or disconnect from the tubular or seal to or unseal from the tubular, is very advantageous. This is particularly true during any of the operations involving well control, drilling, completion, work-over, fishing or other activities requiring the running and pulling the tubular. This invention also eliminates all of the disadvantages of the prior art devices.

When tubular such as casing is run into a wellbore it is often advantageous to fill each successive section with mud as it is advanced into the wellbore. As the casing or tubing advances into the wellbore, a certain amount of mud is displaced. If the tubular is open-ended at the bottom advancement of the tubular into the wellbore will force mud from the wellbore into the tubular and annulus. If the open ended tubular is installed in a wellbore having fairly tight clearances with the tubular, rapid advancement of the tubular into the wellbore will result in significant flow of mud through the tubular and onto the rig floor area. In addition when fluid is flowing from the tubular it is difficult to determine whether the flow is from decompression of the fluid column or flow from a formation in the well bore. If it is flow from a formation it is advantageous to provide a method of rapidly sealing on the tubular or making a threaded connection to the tubular to control the well.

When attempting to pull the tubular from the wellbore, resistance to extraction can be experienced and consequently "swabbing in" and ultimate loss of control of the well could occur. It is obvious that it would be advantageous to add fluid to the tubular to maintain sufficient hydrostatic pressure in the wellbore while extracting the tubular.

Thus, there arises a need for a device that will simply allow capturing of any displaced returns during advancement of the tubular or, alternatively, allow rapid filling of the tubular and wellbore for insertion into or extraction out of the wellbore.

As the tubular is advanced into the wellbore pressure is built up in the well and is relieved only by flowing to the surface or being forced into the formation. Since the well fluids are generally compressible fluid will continue to flow from the well after the tubular string is set in the slips at the rig floor. For this reason it is desirable to provide a method of relieving this pressure at the rig floor prior to retracting the seal of the present invention.

Another advantage of the present invention is to be able to handle sudden surges of pressure from the formation. In these situations, it is desirable to be able to secure a valve in the tubular string connected to the mud supply so that the pressure surge from the wellbore can be contained. Thus, an objective of the present invention is to allow rapid connection or release from a tubular being added or removed to or from a tubular string during insertion or removal operations.

In addition it is another object of the present invention to provide an integral safety valve that is can be manually operated so as to shut-in the well and thereafter allows control of the well by applying fluid behind the valve. In addition an objective is to provide a safety valve that is not operated until required to assure its pressure holding integrity.

It is yet another object of the present invention to allow a system of rapid connection and disconnection to the tubular for filling or capturing of returns with minimal or no spillage in the rig floor area.

It is another object of the present invention to allow circulation of fluid at any time during rig operations for conditioning the wellbore, fluid system, or controlling a kick.

It is another object of the present invention to provide a mud saver valve to prevent fluid from escaping the tool when the tool is disconnected from the tubular without having to operate the manually operated valve.

In addition it is desirable to provide a very large flow path through the mud saver valve to prevent erosion. In addition it is also desirable to provide a large return flow path through the mud saver valve to allow fluid to flow from the tubular with little restriction.

Another object of the present invention is to provide a singular control system for extending and retracting the seal unit of the present invention.

In some circumstances when control of the well requires the tubulars to be run into the well under pressure a safety valve is attached to the tubular and is run into the well along with additional tubulars. Therefore it is another objective of the present invention to provide a means for removal of the mud saver valve and the outer components of the apparatus and the attachment of the integral safety valve to the tubulars to allow the tubulars to be run into the well.

In some circumstances the outside of the tubular connection will become damaged due to tong marks of other damage caused by handling or normal wear while running the tubular in and out of the well that will prevent sealing on these surfaces. In most tubular connections there are closely controlled dimensional tolerance surfaces inside the female connection and not part of the tubular body immediately above and or below the threaded portion of the tool joint or coupling. These surfaces are excellent alternative sealing surfaces not subject to damage as are external surfaces of tubular connections. Use of these surfaces also eliminates the flow restrictions of the tubular body found in previous devices that require a seal to be inserted into the tubular body. Therefore it is another objective of the present invention to provide a means of sealing at these surfaces and to provide the largest possible non-restricting flow area.

Prior systems relating to techniques for filling casing are disclosed in U.S. Pat. Nos. 5,152,554; 5,191,939; 5,249,629; 5,282,653; 5,413,171; 5,441,310; 5,501,280 as well as U.S. Pat. No. 5,735,348.

Other prior art for changing the spacing of devices above the tubulars are disclosed in U.S. Pat. No. 5,577,566 and 5,918,673.

SUMMARY OF THE INVENTION

A system for capturing displaced fluid or pumping fluid through tubulars being run into or out of the wellbore is described. Embodiments are supported by a traveling block and top drive unit with telescoping features to rapidly seal over a tubular to connect the tubular to a mud system. Alternative sealing arrangements for sealing inside the tubular connection are also disclosed. These alternate sealing arrangements also provide flow areas larger than the tubular body since no portion of these arrangements enter the tubular body. All of the sealing arrangements provide a biased area whereby any internal pressure in the invention forces the seals into more intimate contact with their mating seal surfaces. A mudsaver valve having a large flow capacity is described to keep fluid from spilling when the apparatus is removed from the tubular. This mudsaver valve also provides for pumping of fluid into the tubular or flow of fluid from the tubular to the mud system prior to removing the apparatus from the tubular. In these embodiments, the apparatus can be placed in threaded sealing contact with the tubular and can incorporate a safety valve that can be manually closed in the event of a well kick. In another embodiment, a singular control input accomplishes operation of the apparatus to extend or retract the telescoping feature. Also illustrated is a drain valve that provides a method of completely removing all fluid pressure from within the apparatus prior to removing the apparatus from the tubular. The drain system also provides a means of disposing of the excess fluid away from the rig floor where spillage is a danger to the personnel or environment. The drain system can also be connected to a scavenger system that is intended as a vacuum system for removal of spillage. Connection to this system eliminates all possible spillage and completely removes fluids from the tubular handling area.

DETAILED DESCRIPTION OF THE PREFERRED EMBODIMENT

Figure 1:
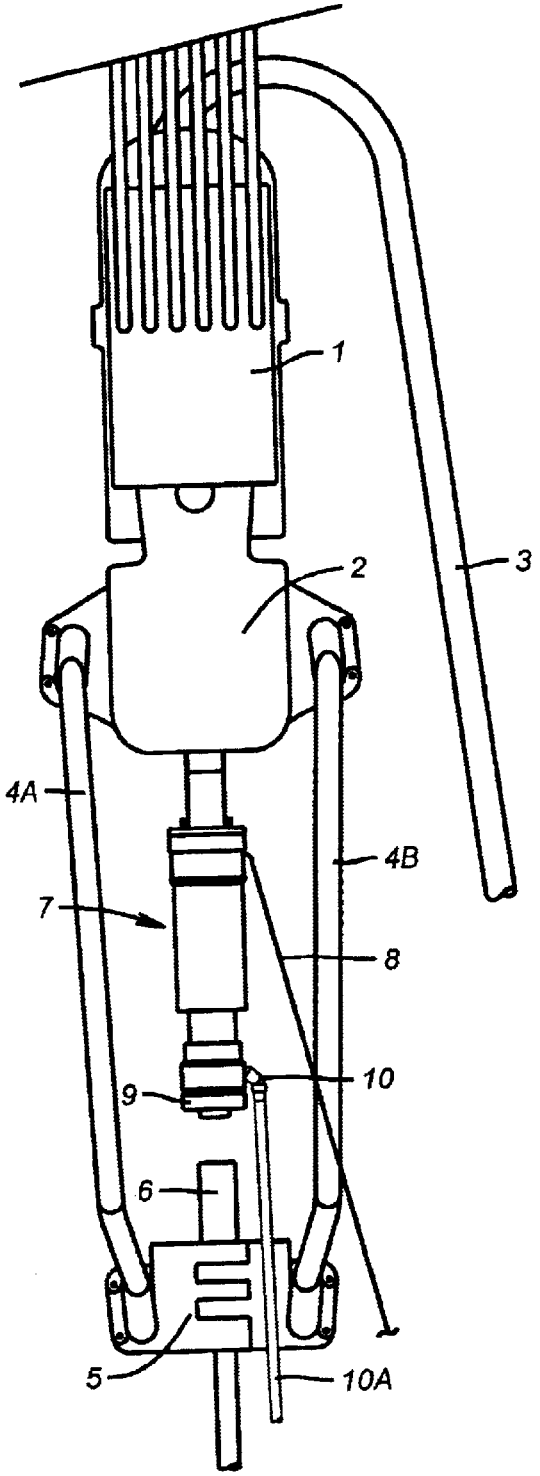
FIG. 1 is an overall view of the invention connected to a top drive rig showing the general position of major components with the seal unit retracted.

Referring now to FIG. 1, the invention (7) is shown connected to a top drive (2) which is hoisted by a traveling block (1). A mud line (3) is connected to the top drive and is connected to the mud system (not shown). A tubular (6) is shown being supported by an elevator (5) that is connected to the top drive by bails (4A and 4B). The tool (7) is shown in the retracted position with the seal unit (9) above the tubular (6). In this position it is easily understood that tubulars can be handled in a normal way. A single control line (8) is shown connected to the invention. A drain valve (10) is illustrated at the lower end of the extendable seal unit. A hose (10A) is shown attached to the drain valve (10). The operation of all of these elements will be explained in detail later.

Figure 2:
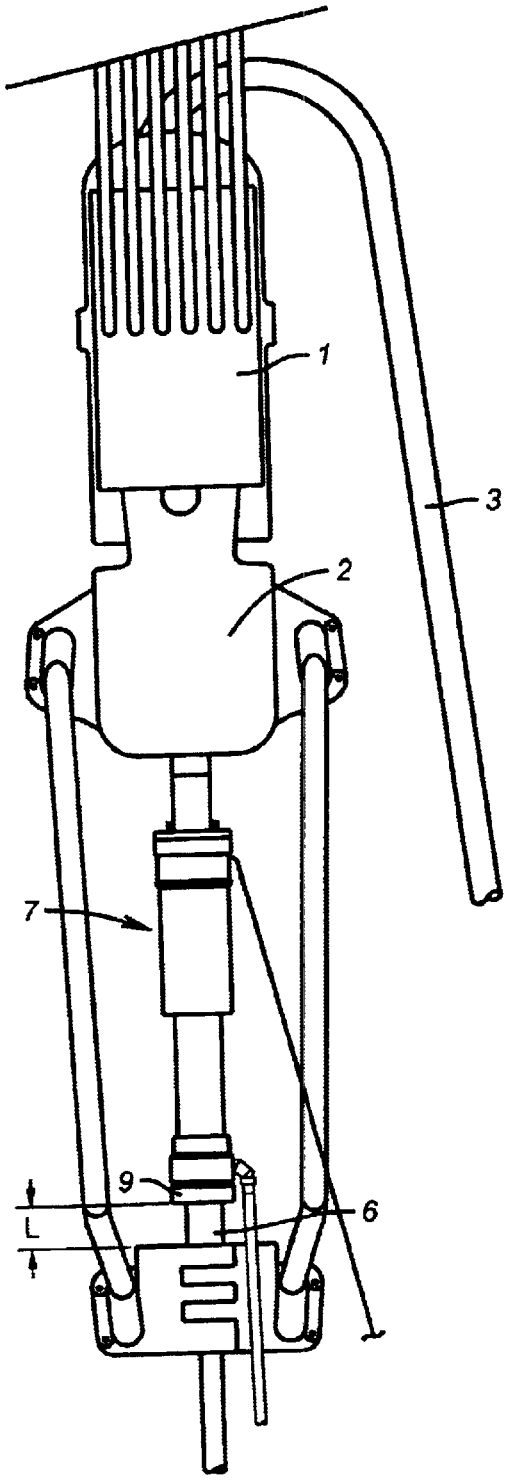
FIG. 2 is an overall view of the invention connected to a top drive rig showing the general position of major components with the seal unit extended and sealing on a tubular positioned in the elevators.

Referring now to FIG. 2, the invention (7) is shown with the seal unit (9) extended and sealing on the tubular (6). In this position fluid can be pumped into or taken from the tubular through the top drive (2) and flow line (3) or the drain valve (10) and hose (10A).

Figure 3:
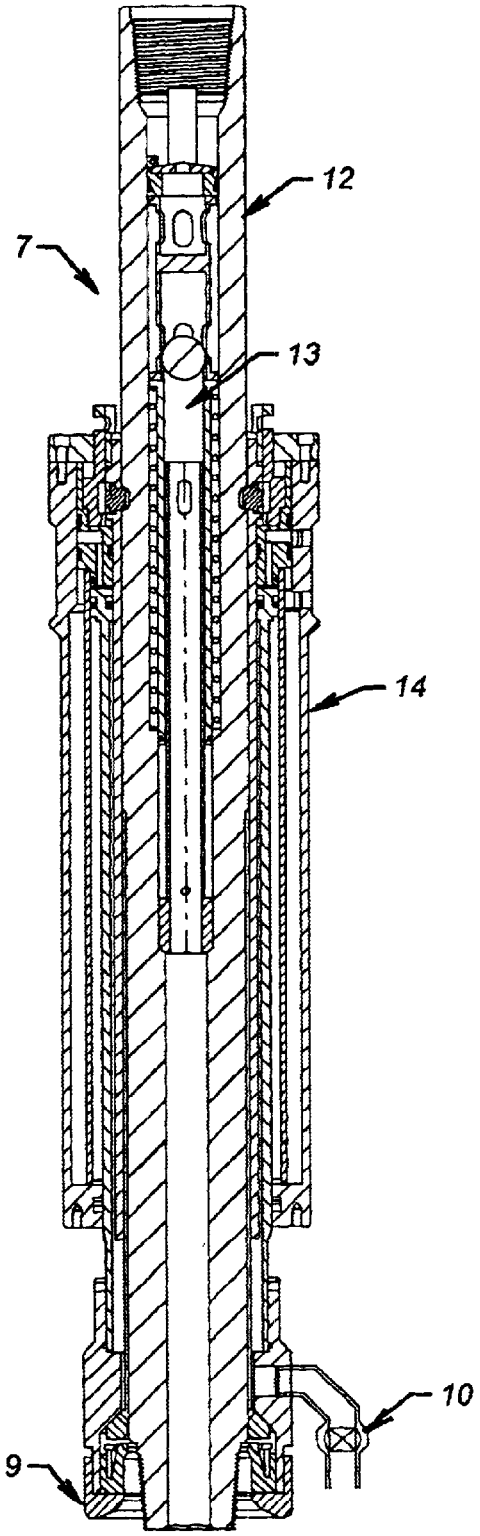
FIG. 3 is a sectional elevational view of one embodiment employing a telescoping feature, a built-in mudsaver valve for preventing mud spilling and a drain connection.

Referring now FIG. 3, the tool (7) is shown with a mandrel (12) and removable outer components (14). The outer assembly is a telescoping unit with a lower seal. The position of the entire unit can be varied with respect to mandrel (12). The preferred drive is hydraulic with a single inlet (8) for applying or removing fluid pressure to actuate the telescoping assembly against a pressure source of a spring. A mudsaver valve (13) is shown inside the mandrel (12). The seal unit (9) is shown in the retracted position with the drain valve (10) attached to the extendable seal unit (9). The operation of the elements will be explained later.

Figure 4:
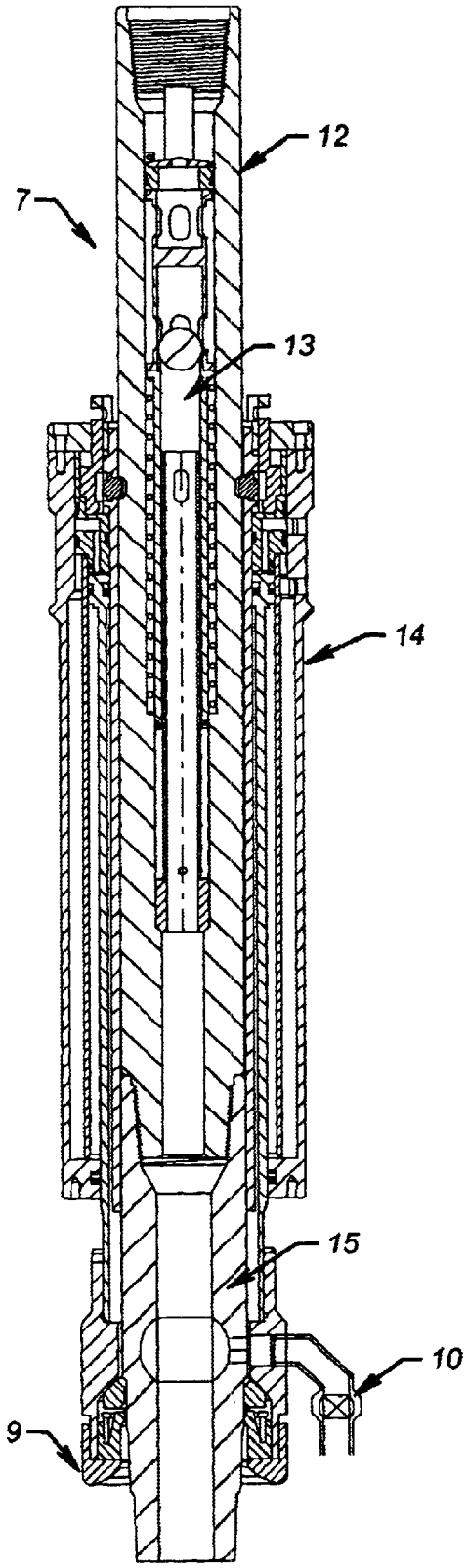
FIG. 4 is a sectional elevational view of another embodiment employing a telescoping feature, a safety valve and a mudsaver valve in combination and a drain connection.

Referring now to FIG. 4, the tool (7) is shown with a mandrel (12) having a mudsaver valve (13) and a safety valve (15). This figure and FIG. 3 illustrate the flexibility of using different valves in different positions to accomplish the objective of controlling flow of fluids to or from the tubular in different ways.

Figure 5:
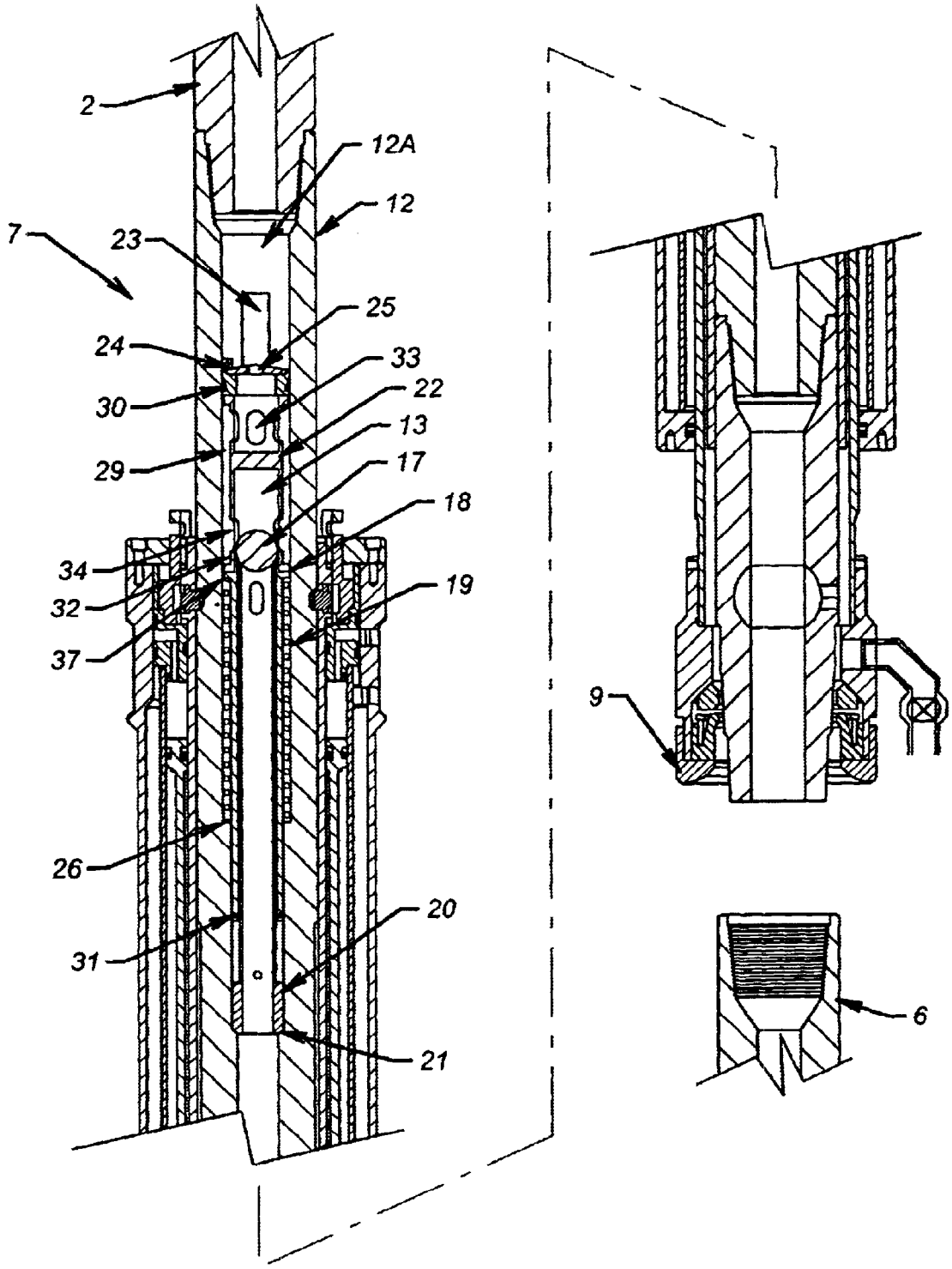
FIG. 5 is a sectional elevational view of the embodiment in FIG. 4 attached to the traveling block or top drive showing the apparatus retracted and approaching a tubular member.
Figure 5A:
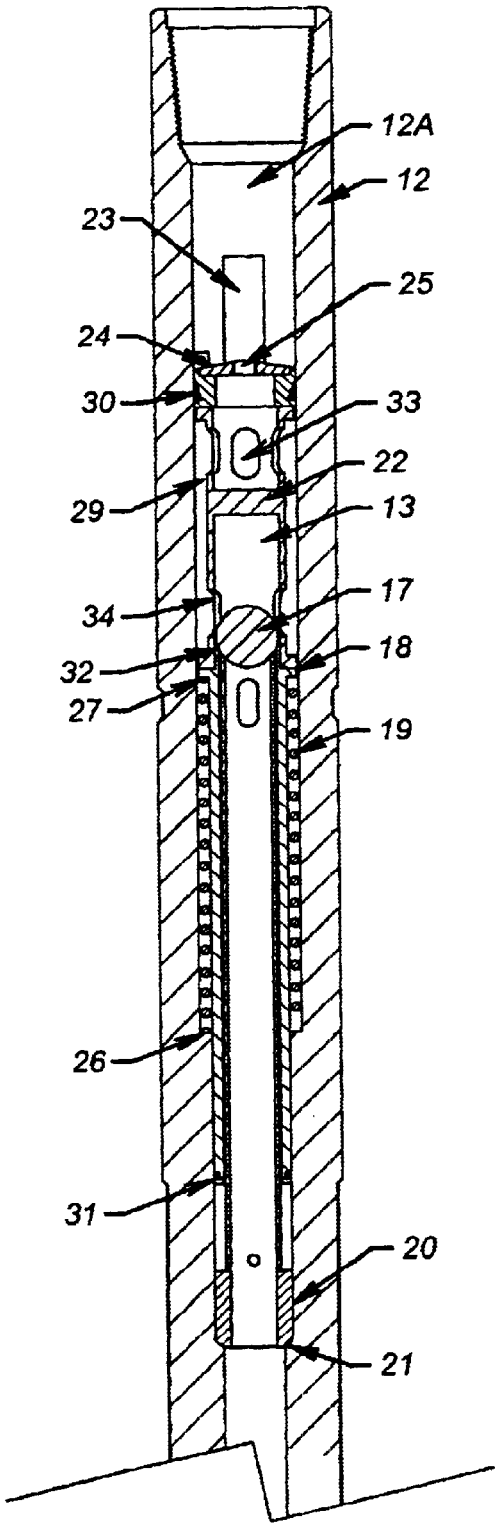
FIG. 5A is a sectional elevational view of the mud saver valve embodiment of FIG. 5.
Figure 5B:
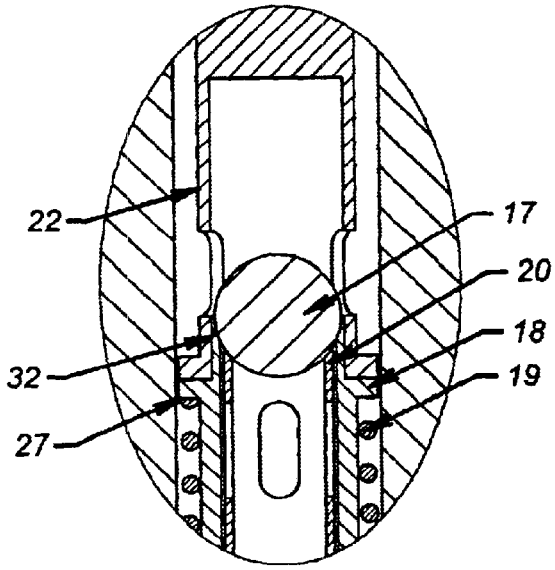
FIG. 5B is a detail view of the valve and seat embodiment of FIG. 5.

Referring now to FIGS. 5, 5A and 5B the invention (7) is shown with a mudsaver valve (13). The sleeve (20) of the mudsaver valve (13) resting on shoulder (21) of the mandrel (12). The ball (17) is shown resting on the top of the sleeve (20). The ball (17) seals at the upper end of the seal sleeve (18) at the seat (32). The seal sleeve (18) is held against the ball (17) by a spring force exerted by the spring (19) against shoulder (27). Spring (19) is resting on its opposite end on the mandrel (12) at shoulder (26). The seal sleeve (18) has a sliding seal (31) at its lower end and a seal at its upper end where the ball (17) rests against seat (32). The ball (17) is free to move upward inside of the diverter tube (22). A flapper valve (23) rests on top of the diverter tube (22) and contains a flapper (24) having an orifice (25) and seals (30) in sealing contact with the mandrel (12).

With the top drive (2) traveling block (1) and mud line (3) full of fluid (FIG. 1), the resulting head pressure is exerted against the ball (17) and seal sleeve (18). The resultant force applied by the pressure above the ball (17) and the area of the seat (32) is supported by the sleeve (20) holding the ball (17) in place. The seal unit (9) is shown in a partially extended.

Figure 6:
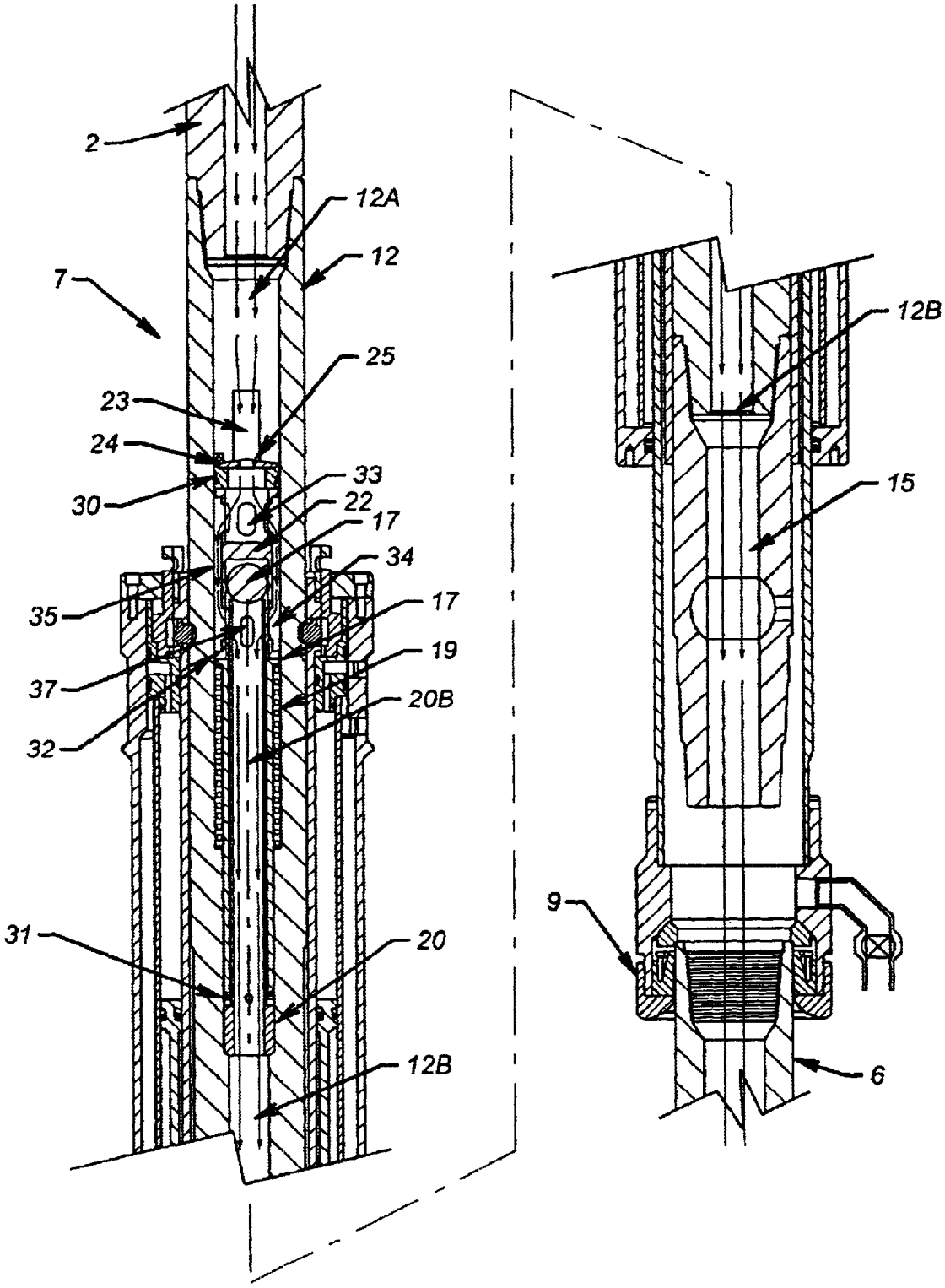
FIG. 6 is a sectional elevational view of the embodiment in FIG. 5 showing the apparatus extended to seal on a tubular member and fluid being pumped into the well and the operation of the mudsaver valve.

Referring now to FIG. 6, the seal unit (9) is shown extended and sealing on the tubular (6). As the pumps are started pressure in the flow path (12A) of the mandrel (12) begins to increase. This pressure exerts a force on the seal sleeve (18) equal to the pressure times the annular area between the seat (32) (FIG. 5B) and sliding seal (31). When the force on the seal sleeve (18) exceeds the force of the spring (19) the seal sleeve (18) will begin to compress the spring (19) and will begin to move downward to open the ports (34) as a bypass around valve seat (32).

After the ball (17) is pushed down to sleeve (20), the flow through the orifice (25) of the flapper (24) will cause a pressure drop at the orifice (25). This pressure drop will exert a force on the flapper valve assembly (23) equal to the pressure drop times the area of the seal (30). This force will be applied to the diverter tube (22) and then to the seal sleeve (18) further compressing the spring (19) until spring is fully compressed and the ports (34) byass the ball (17) no longer on seat (32). Flow then exits the ports (33) of the diverter tube (22) through the annular area (35) between the diverter tube (22) and mandrel (12) and back into the ports (34) of the diverter tube (22). The flow then enters the flow path (20B) in the sleeve (20) and exits through the flow path (12B) of the mandrel (12) and safety valve (15) into the tubular (6). It is clear that this arrangement places the ball (17) and seat (32) completely out of the flow path of the fluid. This is an important feature in preventing erosion of the ball (17) or seat (32). This arrangement also allows the use of large flow areas exceeding the flow area of the mandrel (12) or the tubular (6).

Figure 7:
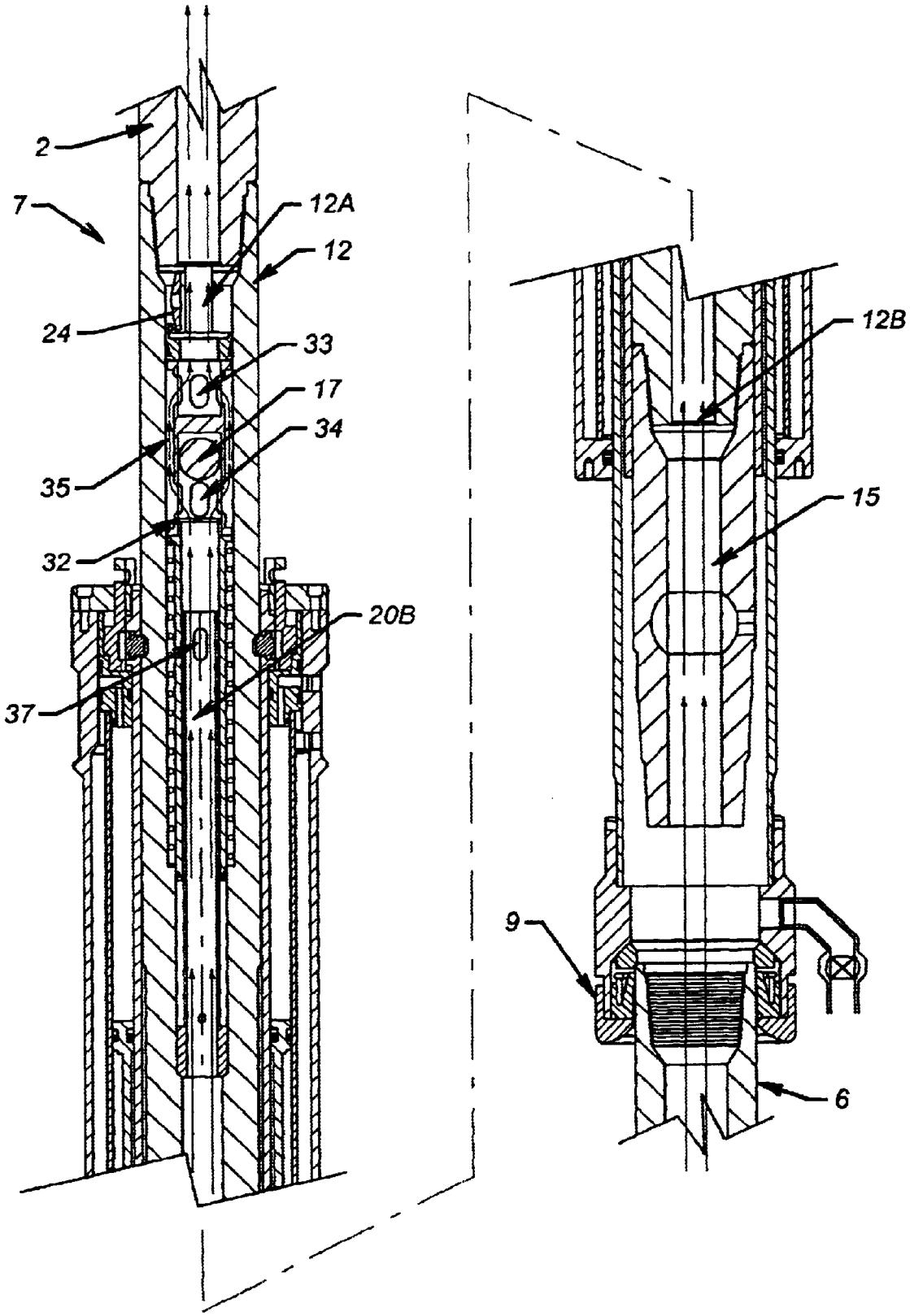
FIG. 7 is a sectional elevation view of the embodiment of FIG. 5 showing the apparatus extended to seal on the tubular member and fluid flowing from the tubular into the apparatus and the operation of the mudsaver valve.

Referring now to FIG. 7, the seal unit (9) is shown extended and sealing on the tubular (6). As the tubular (6) is lowered into the well by advancing the top drive (2, FIG. 1) and traveling block (1, FIG. 1) fluid may begin to enter the lower end of the tubular. This fluid will come out of the tubular (6) into the seal unit (9), through the safety valve (15), through the lower flow path (12B) of the mandrel (12) through the flow path (20B) of the sleeve (20). When the flow reaches the ball (17), the force of the fluid will force the ball (17) off of its seat (32) allowing the fluid to exit the flow port (34) of the diverter tube (22). The fluid then flows through the annular space (35) between the diverter tube (22) and mandrel (12) into the upper end of the diverter tube (22) through ports 33. The force of the flow will then open the flapper (24) allowing fluid to enter the mandrel (12) flow path (12A) and into the top drive (2). It is easy to see that this configuration of the ball (17) and flapper (24) provides a very large return flow path for well fluids allowing fluid to flow freely to the mud system.

Figure 8:
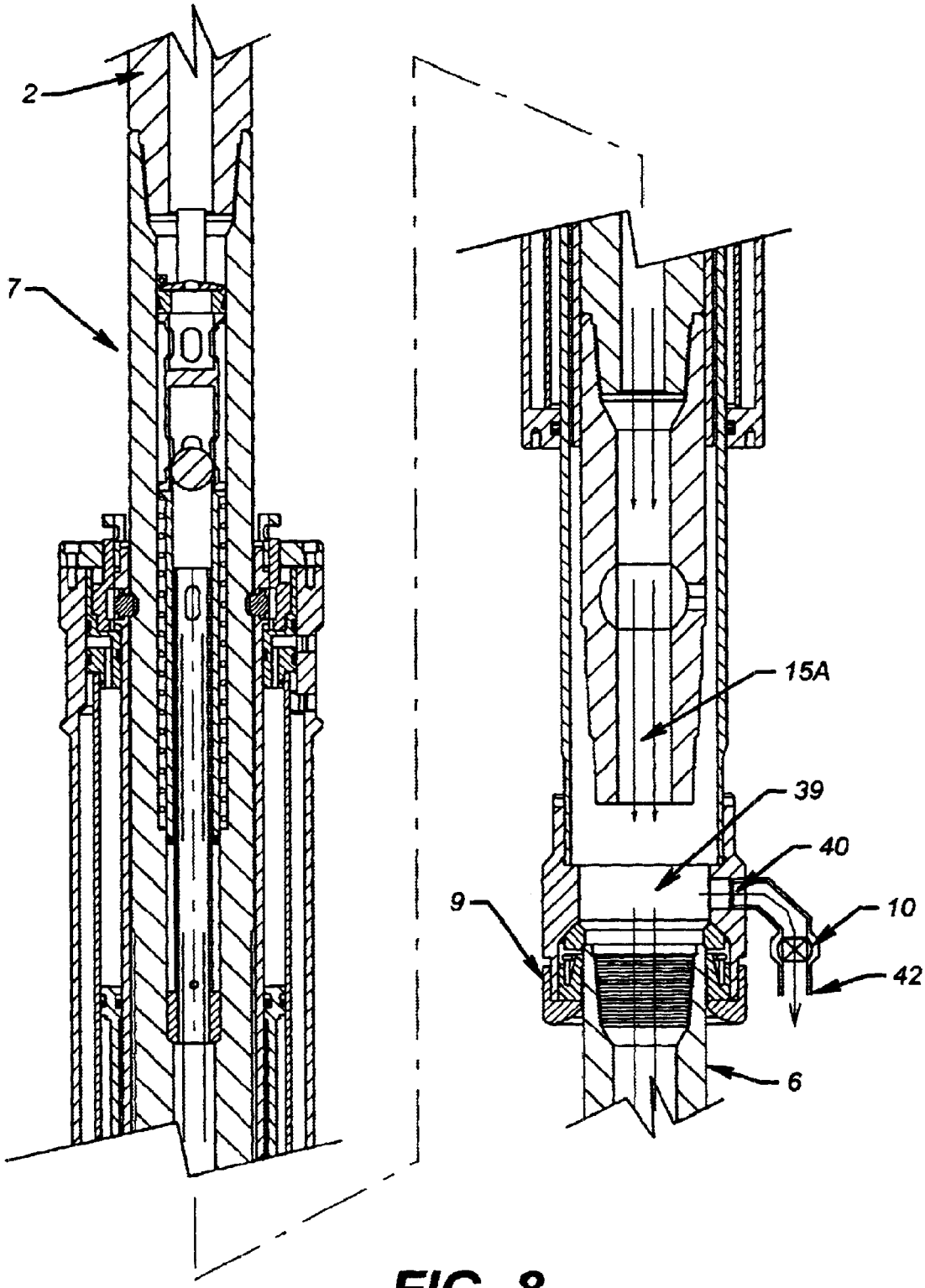
FIG. 8 is a sectional elevation view of the embodiment of FIG. 7 showing fluid being drained from the drain connection.

Referring now to FIG. 8, the apparatus (7) is shown connected to top drive (2) at one end and extended and sealing on tubular (6) at the other end. Fluid is shown draining from the apparatus (7) at the flow path in the safety valve (15A) and the tubular (39). This fluid is directed to the rig mud or scavenger systems (not shown) through the port (40) and controlled by the drain valve (10). A connection (42) is provided to allow quick connection to a hose or other fluid containment fittings. The connection (42) provides for disposal of the drained fluid below the rig floor. The connection (42) can also be attached to a rig vacuum system for complete disposal of the drained fluids.

Figure 9:
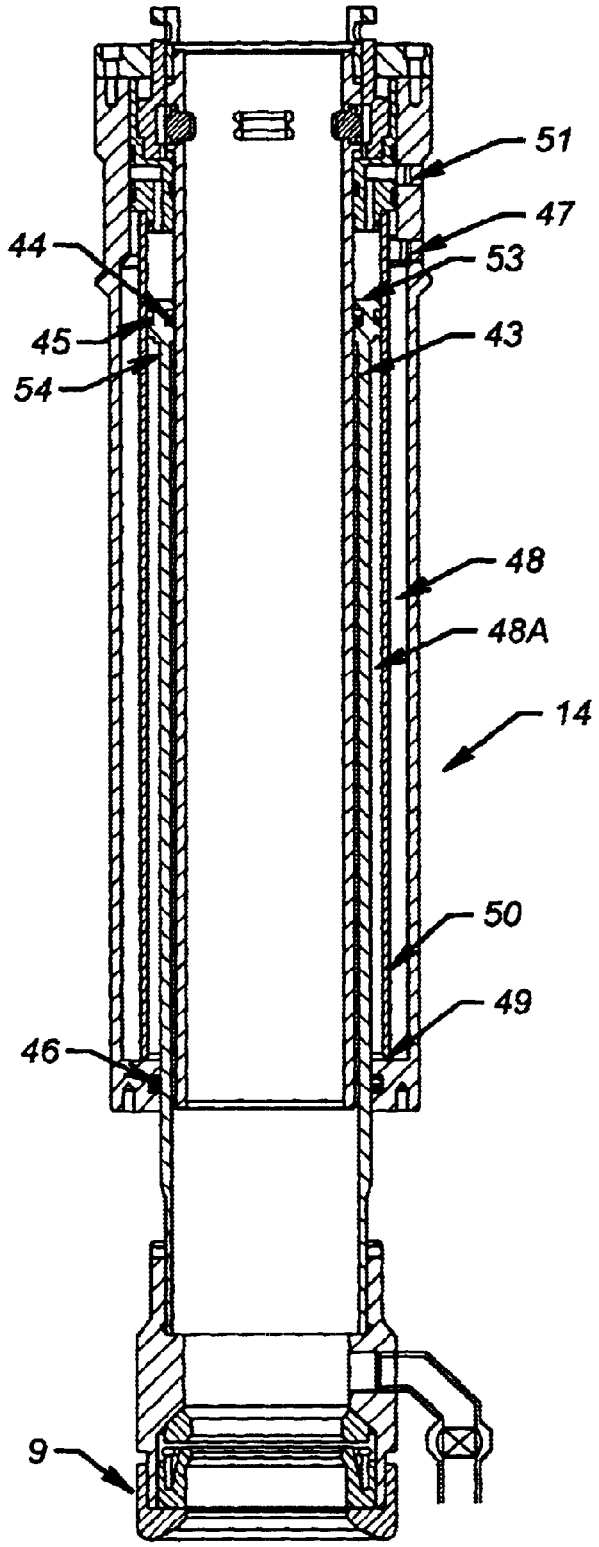
FIG. 9 is a sectional elevation view of the outer components of the invention to illustrate the single control input function.

Referring now to FIG. 9, the removable outer components (14) are shown here for clarity. One of the functions of these components is to provide the extending and retracting feature. The piston (43) is shown partially extended to assist in the description of the apparatus, the piston (43) would normally be fully retracted. A chamber consisting of two annular areas (48 and 48A) is formed by seals (44, 45 and 46) and a plug at port (47) and a port (49) at the lower end of the sleeve (50). This chamber can be pre-charged with a compressible fluid or gas to a pressure sufficient to retract the piston (43). In order to extend the piston (43) further it is only necessary to apply sufficient pressure to port (51). This pressure acts on the end area (53) of the piston (43) to generate a force to extend the piston (43). The force developed by pressurizing the extending port (51) and exerting a force at seals (44) and (45) is resisted by the force developed at the piston area (54) at seals (45) and (46) and pressure in the chamber (48 and 48A). As the piston (43) extends the pressure in chamber (48 and 48A) will increase due to the reduction in the chamber volume.

When it is desirable to retract the piston (43) all one has to do is release the pressure at extending port (51). The pressure of the compressed fluid or gas in chamber (48 and 48A) will act on the piston area (54) to move the piston (43) to the fully retracted position.

Port (51) can be plugged forming a chamber above the piston (53) and a pre-charge pressure applied to this chamber for extending the piston (53). Operating pressure can then be applied to port (47) for retracting piston (53).

A single control input at either port (51) or (47) that could be used to extend or retract the piston (53).

Figure 10:
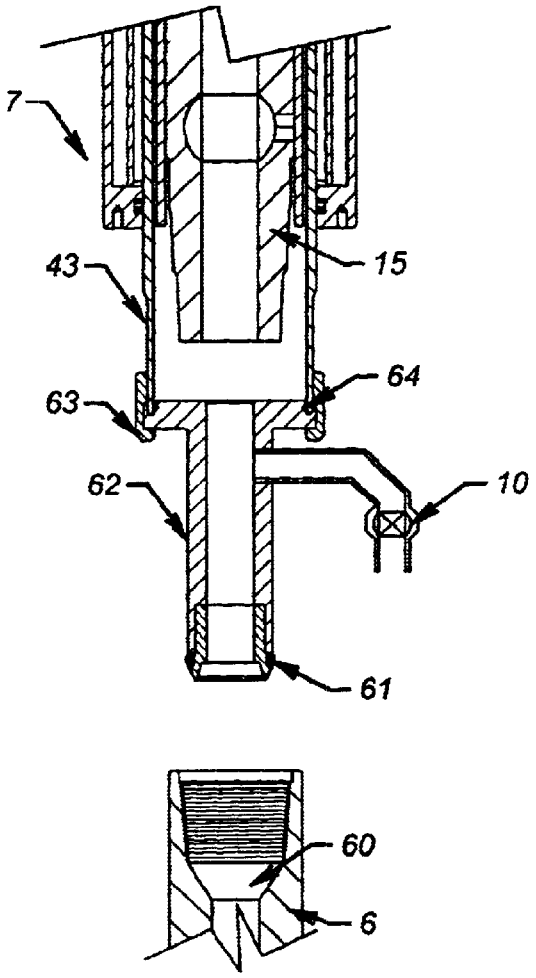
FIG. 10 is a truncated sectional elevation view of an alternate embodiment of the sealing member at the lower end of the extending unit.

Referring now to FIG. 10, the extending and retracting piston (43) of the apparatus (7) is shown in the retracted position. A nose (62) having a seal (61) is attached to the piston (43) with a nut (63), the nose is sealed against the piston (43) with a seal (64). The drain valve (10), mud saver valve (13 not shown) and safety valve (15) function as in the previous figures, and will not be explained in detail here. In the manufacture of tubular connections (6) a surface (60) is created below the threaded portion (65) of the tubular (6). This surface has specific dimensions and tolerances as stipulated by the American Petroleum Institute (API) or the thread manufacturer and provides an excellent surface for sealing purposes. Being on the interior of the tubular connection (6) this surface remains an excellent sealing surface and is not subject to damage due to handling or abrasion due to running, pulling or rotation of the tubular. This surface is also above and larger than the inside diameter of the tubular body.

Figure 11:
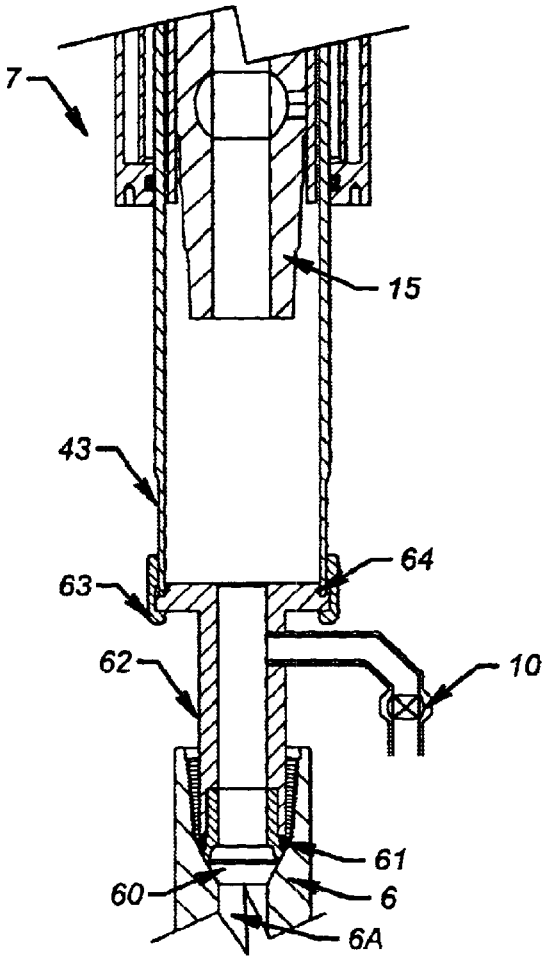
FIG. 11 is a truncated sectional elevation view of the apparatus in FIG. 10 showing the unit in sealing contact inside a tubular connection.

Referring now to FIG. 11, when the piston (43) is extended, the nose (62) is inserted into the tubular connection. The seal (61) is forced into sealing contact with surface (60) below the threads of the tubular connection (6). As pressure is applied to the inside of the apparatus (7) through the mandrel passage (12B FIG. 7) an additional force is applied to the seal (61). This force is due to the difference in area between seal (44 FIG. 9) of the piston (43) and the seal (61) sealing at the surface (60) of the tubular connection (6). It is clear that the inside diameter of the seal (61), nose (62), piston (43), safety valve (15) and mandrel passage (12B FIG. 7) are at least as large as the passage (6A) through the tubular connection (6). This arrangement of seal (61) and seal surface (60) therefore provide for an arrangement such that there is no restriction in flow area through the apparatus (7) to the tubular itself.

Therefore the invention provides for a sealing arrangement whereby the sealing surface is dimensionally stable, not subject to damage or abrasion and larger than the tubular body.

Figure 12:
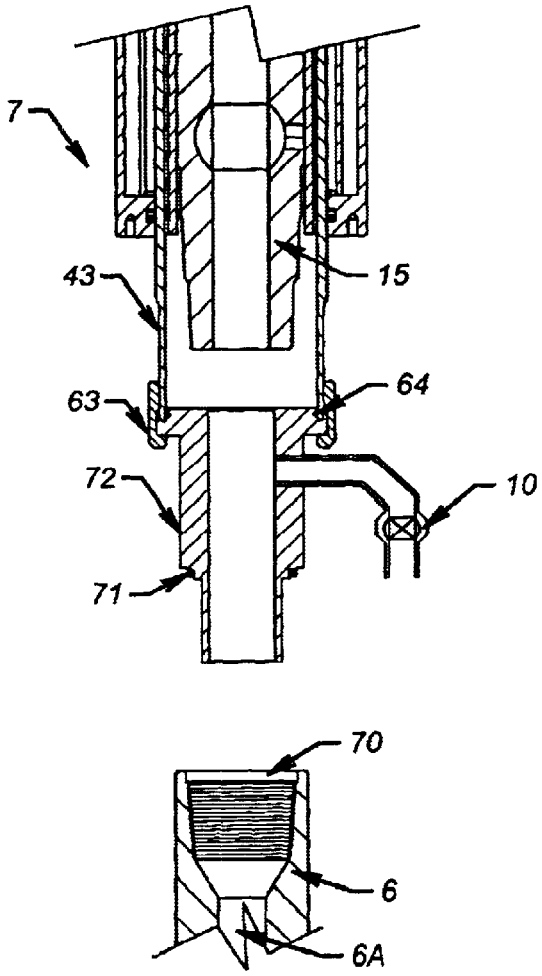
FIG. 12 is a truncated sectional elevation view of an alternate embodiment of yet another sealing member at the lower end of the extending unit.

Referring now to FIG. 12, the extending and retracting piston (43) of the apparatus (7) is shown in the retracted position. A nose (72) having a seal (71) is attached to the piston (43) with a nut (63), the nose is sealed against the piston (43) with a seal (64). The drain valve (10), mud saver valve (13 not shown) and safety valve (15) function as in the previous figures and will not be explained in detail here. In the manufacture of tubular connections (6) a surface (70) is created above the threaded portion (65) of the tubular connection (6). This surface has specific dimensions and tolerances as stipulated by the American Petroleum Institute (API) or the thread manufacturer and provides an excellent surface for sealing purposes. Being on the interior of the tubular connection (6) this surface remains an excellent sealing surface and is not subject to damage due to handling or abrasion due to running, pulling or rotation of the tubular. This surface is also above and larger than the inside diameter of the tubular body (6A).

Figure 13:
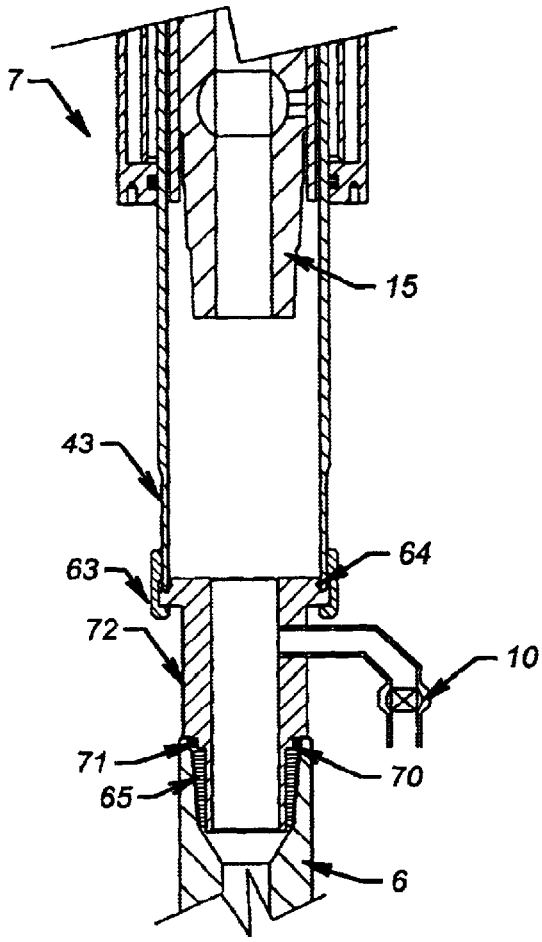
FIG. 13 is a truncated sectional elevation view of the apparatus in FIG. 10 showing the unit in sealing contact inside a tubular connection.

Referring now to FIG. 13, when the piston (43) is extended, the nose (72) is inserted into the tubular connection. The seal (71) is forced into sealing contact with surface (70) above the threads (65) of the tubular connection (6). As pressure is applied to the inside of the apparatus (7) through the mandrel passage (12B FIG. 7) an additional force is applied to the seal (71). This force is due to the difference in area between seal (44 FIG. 9) of the piston (43) and the seal (71) sealing at the surface (70) of the tubular connection (6). It is clear that the inside diameter of the seal (71), nose (62), piston (43), safety valve (15) and mandrel passage (12B FIG. 7) are at least as large as the passage (6A) through the tubular connection (6). This arrangement of seal (71) and seal surface (70) therefore provide for an arrangement such that there is no restriction in flow area through the apparatus (7) to the tubular itself.

Therefore the invention provides for a sealing arrangement whereby the sealing surface is dimensionally stable, not subject to damage or abrasion and larger than the tubular body.

The present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized.

The objectives of the present invention are accomplished through the designs illustrated and described below where the preferred embodiment and alternative embodiments are specified in greater detail. Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention.

Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods that do not depart from the spirit and scope of the present invention.

The present invention recognizes and addresses the previously-mentioned problems and long-felt needs and provides solutions to those problems and a satisfactory meeting of those needs in its various possible embodiments and equivalents thereof. To one of skill in the art who has the benefits of this invention's realizations, teachings, disclosures and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

What is claimed:

1. A fill up and circulation apparatus for inserting tubulars into a wellbore, comprising:

a mandrel having a passage therethrough and selectively sealingly attachable to the tubular;

a mud saver valve in said passage of said mandrel;

said passage in said mandrel comprises a lower and an upper end, said mud saver valve presents a cross-sectional flow area for flow from said lower to said upper end as the mandrel, is sealingly engaged to and advanced in tandem with the tubular into the wellbore, at least equal to the cross-sectional flow area for flow when fluid is pumped from said upper end to said lower end and into the wellbore through said mud saver valve.

2. A fill up and circulation apparatus for tubulars comprising:

a mandrel having a passage therethrough;

a mud saver valve in said passage of said mandrel;

said passage in said mandrel comprises a lower and an upper end, said mud saver valve presents less resistance to flow from said lower to said upper end than in the opposite direction;

a biased shifting sleeve;

a seat in said shifting sleeve;

a ball retained movably in said shifting sleeve;

at least one port in said shifting sleeve;

whereupon application of pressure to said ball when on said seat from said upper end of said mandrel said port on said shifting sleeve is moved with respect to said ball to define a flow passage which excludes said ball.

3. A fill up and circulation apparatus for tubulars comprising:

a mandrel having a passage therethrough;

a mud saver valve in said passage of said mandrel;

said passage in said mandrel comprises a lower and an upper end, said mud saver valve presents less resistance to flow from said lower to said upper end than in the opposite direction;

a biased shifting sleeve;

a seat in said shifting sleeve;

a ball retained movably in said shifting sleeve;

at least one port in said shifting sleeve;

whereupon application of pressure to said ball when on said seat from said upper end of said mandrel said port on said shifting sleeve is moved with respect to said ball to define a flow passage which excludes said ball;

a travel stop for said ball to allow said port in said shifting sleeve to move beyond said ball to take said ball out of a flow path which includes said port in said shifting sleeve.

4. The apparatus of claim 3, further comprising:

a second travel stop to allow flow from said lower end to said upper end of said mandrel to displace said ball away from said seat and said port in said shifting sleeve.

5. The apparatus of claim 4, wherein:

said mud saver valve comprises a flapper which pivots away from flow going from said lower to said upper end.

6. The apparatus of claim 5, wherein:

said flapper comprises a port therethrough to permit flow from said upper to said lower end when disposed in said passage.

7. The apparatus of claim 6, wherein:

said flapper engaging said shifting sleeve when flow is from said upper to said lower end through said port in said flapper to overcome said bias on said sleeve.

8. A mud saver valve for a fill-up and circulating tool having a mandrel with a flow path therethrough, said mud saver valve mounted in said flow path, and further comprising:

a lower movable sleeve comprising an internal seat and at least one lateral port;

an obstructing member for selectively contacting said seat, whereupon initial pressure buildup with said obstructing member in contact with said seat, said lower movable sleeve translates to define a fluid path from above the obstructing member through said lateral port with said obstructing member disposed outside said fluid path such that flowing fluid having a velocity through said fluid path does not make impact with said obstructing member.

9. A mud saver valve for a fill up and circulating tool having a mandrel with a flow path therethrough, said mud saver valve mounted in said flow path, and further comprising:

a lower movable sleeve comprising an internal seat and at least one lateral port;

an obstructing member for selectively contacting said seat, whereupon initial pressure buildup with said obstructing member in contact with said seat, said lower movable sleeve translates to define a fluid path through said lateral port with said obstructing member disposed outside said fluid path;

said obstructing member moves in tandem with said lower movable sleeve for a portion of the travel of said lower movable sleeve, before contacting a first travel stop.

10. The mud saver valve of claim 9, further comprising:

an upper movable sleeve responsive to fluid flow therethrough to assist in displacement of said lower movable sleeve.

11. The mud saver valve of claim 10, wherein:

said upper movable sleeve serves as a second travel stop for said obstructing member responsive to flow tending to displace said obstructing member away from said seat.

12. The mud saver valve of claim 11, further comprising:

a displaceable orifice in said upper movable sleeve, said orifice functional responsive to fluid flow to drive said upper movable sleeve toward said lower movable sleeve and said orifice is disabled by fluid flow in the reverse direction.

13. The mud saver valve of claim 12, wherein:

said displaceable orifice further comprises a rotatably mounted flapper having an opening therethrough.

* * * * *